United States Patent [19]

Ohwada

[11] Patent Number: 5,002,412

[45] Date of Patent: Mar. 26, 1991

[54] ARMATURE GUIDE FOR WIRE DOT PRINT HEAD

[75] Inventor: Isao Ohwada, Iwate, Japan

[73] Assignee: Alps Electric Co., Ltd., Tokyo, Japan

[21] Appl. No.: 405,099

[22] Filed: Sep. 8, 1989

Related U.S. Application Data

[63] Continuation of Ser. No. 7,084,417, Aug. 10, 1987, abandoned.

[30] Foreign Application Priority Data

Oct. 8, 1986 [JP] Japan ..... 61-154717[U]

[51] Int. Cl.[5] ..... B41J 2/24; B41J 2/28

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,260,270 | 4/1981 | Cavallari | 400/124 GT |
| 4,338,585 | 7/1982 | Volke | 400/124 X |
| 4,441,828 | 4/1984 | Ochiai | 400/124 |
| 4,618,276 | 10/1986 | Blomquist | 400/124 |

FOREIGN PATENT DOCUMENTS

| | | | |
|---|---|---|---|
| 150566 | 11/1981 | Japan | 400/124 |
| 171360 | 8/1986 | Japan | 400/124 |

*Primary Examiner*—David A. Wiecking

*Attorney, Agent, or Firm*—Guy W. Shoup; David W. Heid

[57] ABSTRACT

A print head for use in a wire dot printer has a plurality of wires, an armature connected to each of the wires, a core of a magnetic circuit which is disposed in opposing relation to the armature, a resilient member for biasing the armature in a direction in which it is separated from the core, and a rear case disposed so as to cover the upper side of the armature. Each of the wires is driven by the action of the armature which is attracted toward the core when a coil wound on the core is energized. The print head is provided with an armature guide having a resilient stopper disposed between each armature and the rear case to support the armature against the biasing force from the resilient member. Thus, it is possible to support each armature inserted into the armature guide by means of the stopper even more stably during an assembling step carried out before the rear case is mounted. Accordingly, the assembling operation is simplified and facilitated.

4 Claims, 3 Drawing Sheets

ARMATURE GUIDE FOR WIRE DOT PRINT HEAD

This application is a continuation of application Ser. No. 07/084,417, filed on Aug. 10, 1987 now abandoned.

BACKGROUND OF THE INVENTION

1. Field of the Invention

The present invention relates to a print head for use in a wire dot printer. More particularly, the present invention pertains to a stopper structure for preventing an armature from coming off an armature guide during an assembling process.

2. Description of the Related Art

FIG. 5 is a fragmentary sectional side view showing the internal structure of a conventional print head used in a dot printer.

As illustrated, the print head comprises a casing consisting of a front case 1 and a rear case 2 and a magnetic drive unit accommodated inside the casing. The magnetic drive unit comprises a yoke 3 having a substantially U-shaped cross-section, a core 4 upstanding from the yoke 3, a coil 5 wound on the core 4, an armature 6 made of a magnetic material and disposed between the respective end faces of the yoke 3 and the core 4 on the one hand and the rear case 2 on the other, a wire 7 connected to one end of the armature 6, a return spring 8 interposed between the first end of the armature 6 and the upper end of the yoke 3, a support spring 9 interposed between the other end of the armature 6 and the rear case 2, a damper 10 rigidly secured to the lower surface of the rear case 2, and an armature guide 11 mounted on and secured to the yoke 3.

The armature guide 11 has a plurality of retaining portions 11*a* in correspondence with the armatures 6, respectively, as partially shown in FIG. 6, the retaining portions 11*a* being connected together in one unit through an annular peripheral wall 11*b*. Since the armature 6 is formed so as to have a width slightly smaller than the spacing between a pair of adjacent retaining portions 11*a*, the armature 6 faces the corresponding core 4 in a state wherein the circumferential movement of the armature 6 is limited. The gap (magnetic gap) between the armature 6 and the upper end of the core 4 is set at a given dimension which is determined by the contact of the upper side of the armature 6 with the damper 10.

In the print head having the arrangement described above, when the coil 5 is energized, the armature 6 is attracted toward the core 4 by means of magnetic attraction force, and when the supply of current to the coil 5 is cut off, the armature 6 is returned by means of the resilient force from the return spring 8 which is compressed when the armature 6 is attracted toward the core 4, thereby activating the wire 7 connected to the armature 6, and thus effecting printing.

When the print head arranged as described above is to be assembled, each armature 6 is inserted into the area between each pair of adjacent retaining portions 11*a* of the armature guide 11 through the associated return spring 8, and thereafter, the rear case 2 is fitted to the upper end of the front case 1, thereby bringing the support spring 9 and the damper 10 into contact with the upper end of the armature 6 so as to position the armature 6 in place. Accordingly, in the course of the assembling process, the armature 6 inserted into the armature guide 11 may be pushed back by means of the resilient force from the return spring 8 as shown in FIG. 7, resulting in occurrence of problems such as the armature 6 coming off the armature guide 11 or the wire 7 connected to the armature 6 disengaging from the wire guide 1*a* provided at the distal end of the front case 1.

In order to prevent the occurrence of such problems during the assembling process, if the thickness of the armature guide 11 is increased to prevent the armature 6 from coming off the guide 11 and the length of the wire 7 is increased more than is necessary to prevent the wire 7 from disengaging from the wire guide la, in the former case the thickness of the armature guide 11 is uselessly increased to hinder the reduction in size of the print head, whereas, in the latter case the unnecessary portion of the wire 7 must be cut after the completion of the assembly process, which gives rise to a new disadvantage that the working efficiency is deteriorated.

SUMMARY OF THE INVENTION

In view of the above-described disadvantages of the prior art, it is a primary object of the present invention to provide a print head for a wire dot printer which is so designed that the assembling operation is simplified and facilitated.

To this end, the present invention provides a print head for a wire dot printer, which comprises a resilient stopper for supporting an armature against the resilient force from a return spring, the stopper being provided on a part of an armature guide which is in fixed relation to a core in order to prevent the armature from coming off the armature guide during an assembling step carried out before the rear case is fitted to the front case.

The above and other objects, features and advantages of the present invention will become clear from the following description of the preferred embodiment thereof, taken in conjunction with the accompanying drawings.

BRIEF DESCRIPTION OF THE DRAWINGS

FIGS. 1 to 4 show in combination one embodiment of the present invention, in which:

FIG. 1 is a sectional side view of the print head according to the present invention;

FIG. 2 is a plan view of the armature guide of the print head;

FIG. 3 is a sectional side view of the print head in the course of the assembling process; and FIG. 4 is a fragmentary plan view of an essential part of the print head.

FIGS. 5 to 7 show in combination a prior art, in which:

FIG. 5 is a fragmentary sectional side view of an essential part of the conventional print head;

FIG. 6 is a fragmentary plan view showing the relationship between each armature and the armature guide in the print head; and FIG. 7 is a fragmentary sectional side view of an essential part of the print head in the cource of the assembling process.

DESCRIPTION OF THE PREFERRED EMBODIMENT

One embodiment of the present invention will be described in detail with reference to the accompanying drawings.

Figure 1:
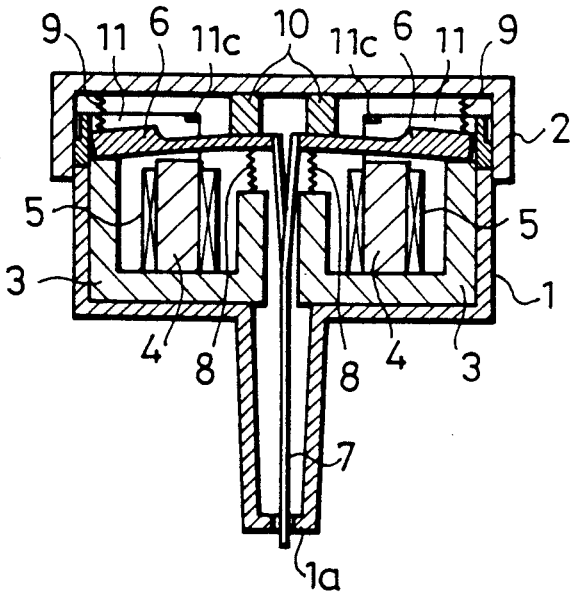
Figure 2:
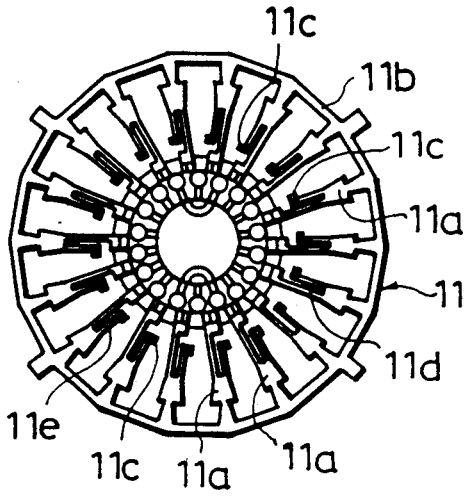

FIG. 1 is a sectional side view of a print head for a wire dot printer in accordance with one embodiment of the present invention, and FIG. 2 is a plan view showing in detail an armature guide which is provided in the print head shown in FIG. 1. In FIG. 1, yokes 3, cores 4, coils 5, armatures 6, wires 7, return springs 8, support springs 9, dampers 10 and the like are similar to those in the prior art which is shown and has been described above and description thereof is therefore omitted.

The feature of this embodiment resides in the structure of the armature guide 11 which is particularly shown in FIG. 2. More specifically, in this embodiment the armature guide 11 which is made of a synthetic resin and has a substantially disk-shaped configuration has retaining portions 11*a* projecting from the peripheral wall 11*b* toward the center of the guide 11, each retaining portion 11*a* having a slit 11*d*. A stopper 11*c* is provided at the substantially distal end portion of a movable piece 11*e* which defines each slit 11*d* in cooperation with the corresponding retaining portion 11*a*, the stopper 11*c* projecting in the circumferential direction of the armature guide 11. The spacing between each stopper 11*c* and the corresponding portion 11*a* is set so as to be smaller than the width of that portion of the armature 6 which faces this stopper 11*c*.

The process for assembling the print head having the armature guide 11 arranged as described above and the function of the stopper 11*c* will be described in detail with specific reference to FIGS. 3 and 4.

Figure 3:
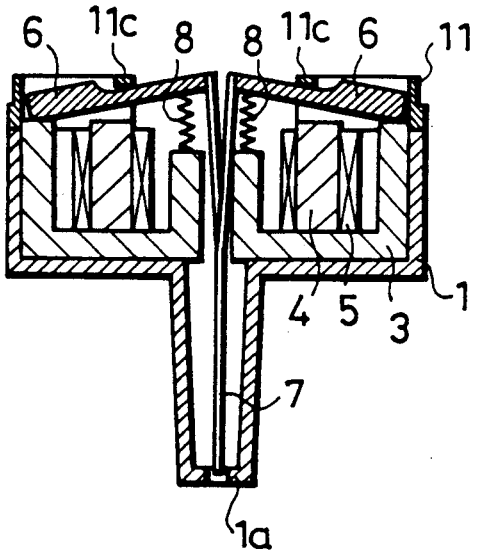
Figure 4:
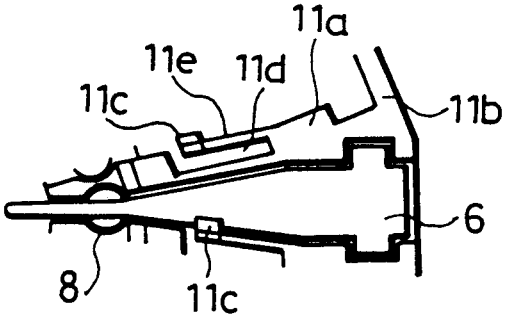
Figure 5:
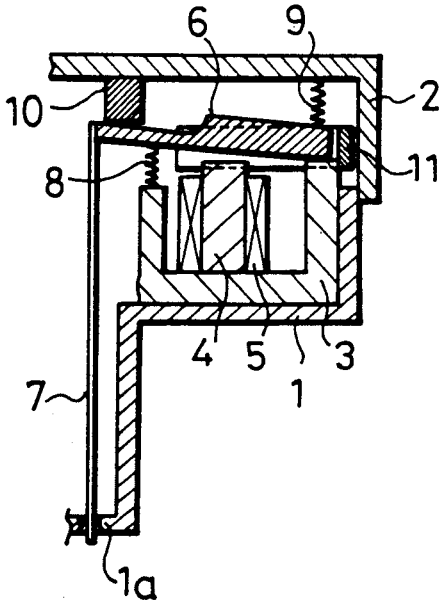
Fig.5 PRIOR ART
Figure 6:
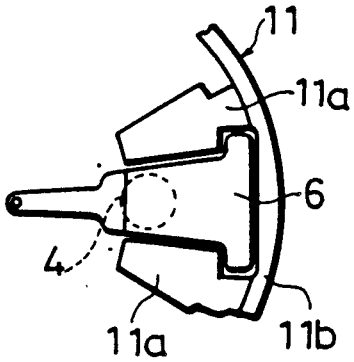
Fig.6 PRIOR ART
Figure 7:
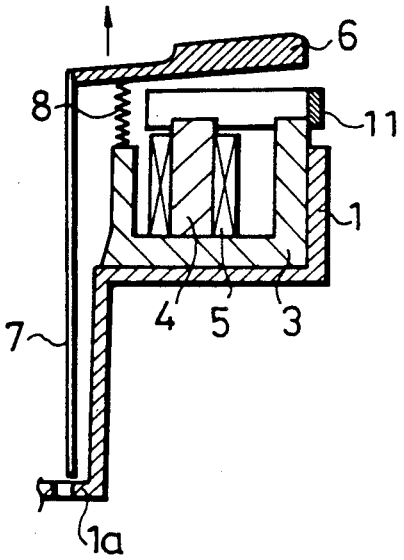
Fig.7 PRIOR ART

After the armature guide 11 has been mounted on the yokes 3 in the same way as in the prior art, each armature 6 is inserted into the area between each pair of adjacent retaining portions 11*a* of the armature guide 11 against the force from the associated return spring 8 as shown in FIG. 3. At this time, the movable piece 11*e*, which is resilient, is expanded by the armature 6 when inserted and thus allows the insertion of the armature 6, but, after the insertion of the armature 6, the movable piece 11*e* returns to its previous position by virtue of its own resilience and brings the stopper 11*c* into contact with the upper side of the armature 6, thus supporting the armature 6 against the resilient force from the return spring 8 (i.e., the armature 6 being in a tentatively retained state). Accordingly, the armature 6 is in contact at its rear end and central portions with the yoke 3 and the stopper 11*c*, respectively, and is thereby stably supported by the armature guide 11, so that the distal end portion of the armature 6 which is connected to the wire 7 is prevented from undesirably rising and there is therefore no fear of the wire 7 from coming off the wire guide portion 1*a*.

After each armature 6 has been tentatively attached to the armature guide 11 as described above, the rear case 2 is fitted to the upper end of the front case 1 to complete the assembling operation. In consequence, the support spring 9 and the damper 10 are in contact with the upper side of the armature 6 as shown in FIG. 1, and the engagement between the armature 6 and the stopper 11*c* during the assembling process such as that shown in FIG. 3 is canceled. Thus, the magnetic gap between the armature 6 and the core 4 is set at a predetermined dimension by means of the damper 10. It should be noted that, since the operation of mounting the rear case 2 to the upper end of the front case 1 can be carried out in a state wherein the armature 6 is stably supported by the armature guide 11, the assembling operation is exceedingly simplified and facilitated. In addition, since it is unnecessary to give the wire 7 an extra length which would otherwise be required to prevent it from coming off the wire guide portion 1*a*, it becomes unnecessary to conduct the operation of cutting the wire 7 after the completion of the assembly.

As has been described above, it is possible, according to the present invention, to support each armature inserted into the armature guide by means of a combination of the associated yoke and stopper even more stably during an assembling step carried out before the rear case is fitted to the upper end of the front case. Accordingly, the assembling operation is simplified and facilitated, advantageously.

Although the present invention has been described through specific terms, it should be noted here that the described embodiment is not necessarily exclusive and various changes and modifications may be imparted thereto without departing from the spirit and scope of the invention which is limited solely by the appended claims.

What is claimed is:

1. A print head for a wire dot printer, comprising:

a plurality of wires, each wire having assembled therewith:

an armature connected to the wire;

a magnetic core disposed in facing relation to said armature for attracting said armature toward the core;

a resilient member coupled to the armature for biasing a portion of said armature away from said core;

the print head further comprising:

a front case having a plurality of guide holes defined therein each for guiding one of the wires when a corresponding armature is attracted by a respective core;

a rear case attached to the front case and having a plurality of dampers each opposing an armature, said rear case being disposed so as to cover an upper side of each armature and damp the movement of each armature after the armature is released from being attracted toward its respective core; and an armature guide having a resilient stopper disposed between each armature and said rear case supporting each said armature from said front case against the biasing force form each said resilient member during assembly of said print head without the attachment of said rear case to said front case and to hold each armature and its associated wire in predetermined relationship to a corresponding one of said plurality of guide holes without attachment of the rear case to the front case, such that when the rear case is attached to the front case the wire is not displaced from its corresponding guide hole, wherein said armature guide has a substantially disk-shaped configuration and is provided with a plurality of armature retaining portions which project from a peripheral wall towards a center of said guide, each armature retaining portion having a slit defined therein separating a moveable portion of said armature retaining portion from said armature retaining portion, said stopper being provided at a substantially distal end portion of said moveable portion and projecting in a circumferential direction of said armature guide.

2. A print head according to claim 1, wherein the spacing between said stopper and the corresponding portion of an adjacent armature retaining portion is set so as to be smaller than a width of that portion of the corresponding armature which faces said stopper.

3. A print head for a wire dot printer, comprising:

a plurality of wires;

a plurality of moveable armatures each connected to one of the wires;

a plurality of magnetic circuits each disposed in opposing relation to a corresponding armature for moving the armature;

a plurality of resilient members each for biasing one of said armatures against an attractive force generated by its corresponding magnetic circuit; and an armature guide having a plurality of resilient stoppers extending from a periphery of the armature guide for temporarily fixing the position of a corresponding armature during assembly of said print head, wherein each said resilient stopper is resiliently moveable out of an assembly path through which a corresponding armature passes when it is installed in the print head during assembly, and wherein said armature guide is substantially disk-shaped and is provided with a plurality of armature retaining portions which project from a peripheral wall thereof towards a center of said guide, each armature retaining portion having a slit defined therein, wherein said slit defines a moveable portion of said armature portion and further wherein said stopper is located at a distal end of said moveable portion and each stopper projecting at least partly in a circumferential direction of said armature guide.

4. A print head according to claim 3, wherein a spacing is defined after assembly between said stopper and the corresponding armature retaining portion, the spacing being smaller than the width of a portion of the corresponding armature which faces said stopper.

* * * * *